United States Patent [19]

Jones

[11] 4,309,594

[45] Jan. 5, 1982

[54] MODULAR INFRARED SPACE HEATER DEVICE

[76] Inventor: John P. Jones, 3270 N. Barnes, Springfield, Mo. 65802

[21] Appl. No.: 78,077

[22] Filed: Sep. 24, 1979

[51] Int. Cl.[3] ..... H05B 1/00; F24H 3/02

[52] U.S. Cl. ..... 219/365; 126/110 R; 165/123; 165/179; 165/185; 219/342; 219/368; 219/370; 219/377

[58] Field of Search ..... 219/359, 361, 365–371, 219/374, 377, 378, 342, 343; 237/16–18; 165/185, 179, 123; 126/110 R

[56] References Cited

U.S. PATENT DOCUMENTS

| | | | |
|---|---|---|---|
| 1,417,427 | 5/1922 | Tracy | 219/367 |
| 1,531,518 | 3/1925 | Simmons | 219/365 |
| 1,534,571 | 4/1925 | Comming | 219/368 |
| 1,705,812 | 3/1929 | Fisher | 219/365 X |
| 2,379,705 | 7/1945 | Graves | 219/370 |
| 2,391,207 | 12/1945 | Van Schaack | 219/367 |
| 2,863,980 | 12/1958 | Logan | 219/367 |
| 2,919,338 | 12/1959 | Covault et al. | 219/367 X |
| 3,180,972 | 4/1965 | Covault | 219/374 X |
| 3,471,681 | 10/1969 | Miller | 219/377 X |
| 3,575,582 | 4/1971 | Covault | 219/370 X |

*Primary Examiner*—A. Bartis

*Attorney, Agent, or Firm*—Lowe, Kokjer, Kircher, Wharton & Bowman

[57] ABSTRACT

A modular infrared heating device having an outer casing which encloses a heating chamber wherein one or more infrared lamps are vertically positioned. The heating device also includes an intake channel which communicates with an opening in the outer casing and with the heating chamber. At least one heat exchanging plate is positioned within the heating chamber adjacent to the infrared lamps such that it is capable of being heated thereby and defines an air discharge channel with a wall of the casing and. This plate has a plurality of open-ended tubular conduits mounted onto it. Each of these conduits is constructed to have a hollow inner channel and is mounted onto the heat exchanging plate such that its hollow inner channel is aligned with a corresponding opening in the plate. The conduits extend into the discharge channel transversely of the direction of flow therein and are curved to present end portions extending parallel to the direction of flow in the discharge channel to induce air flow through the conduits. The heating device is also equipped with a fan which facilitates the circulation of air through the heater. Air moving through the heater passes over the infrared lamps, over both sides of the heat exchanging plate, and through and around the tubular conduits such that it is capable of absorbing heat from these components of the device.

5 Claims, 6 Drawing Figures

Fig. 1.
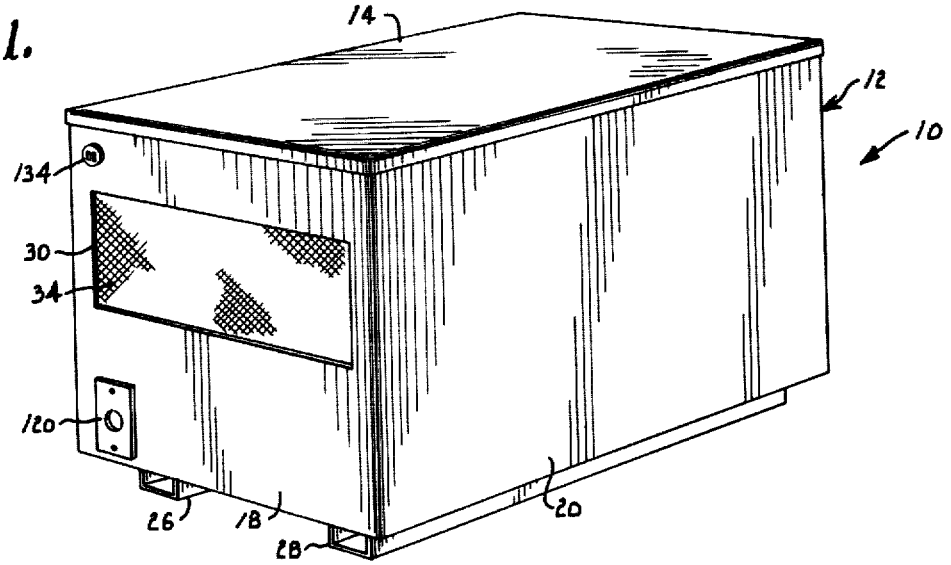
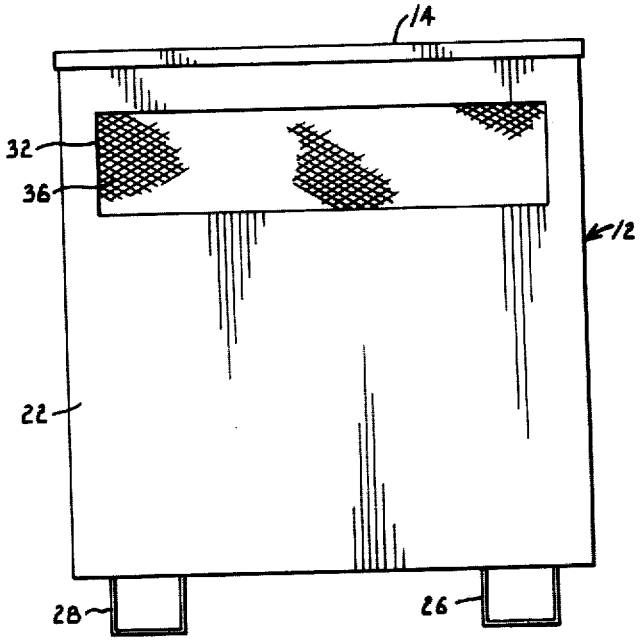
Fig. 2.
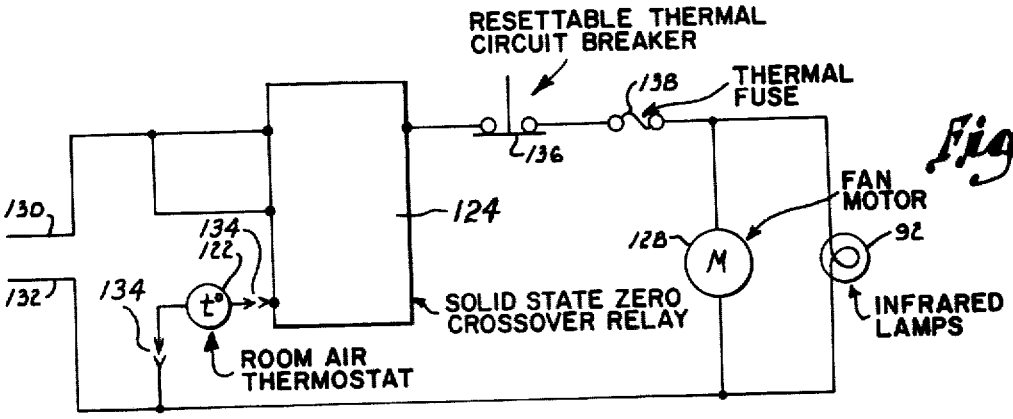
Fig. 6.

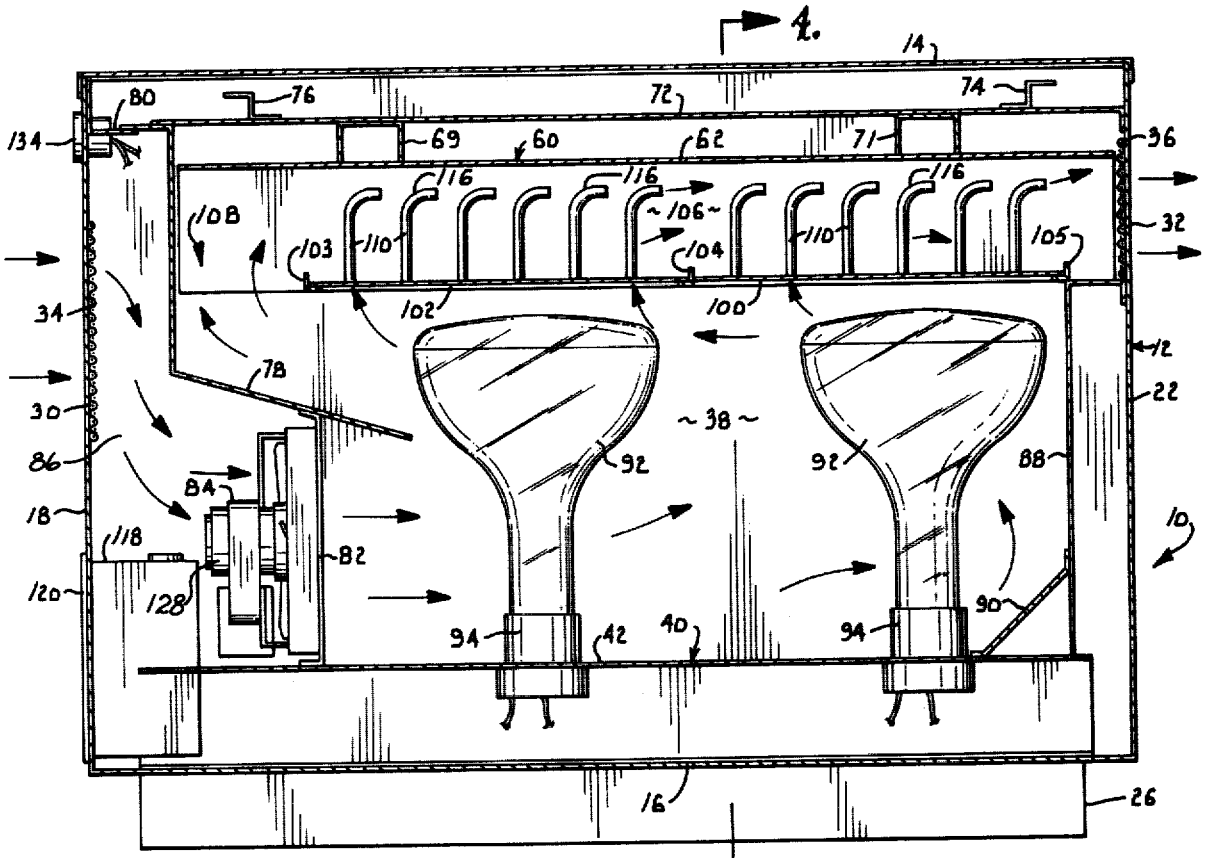
Fig. 3.
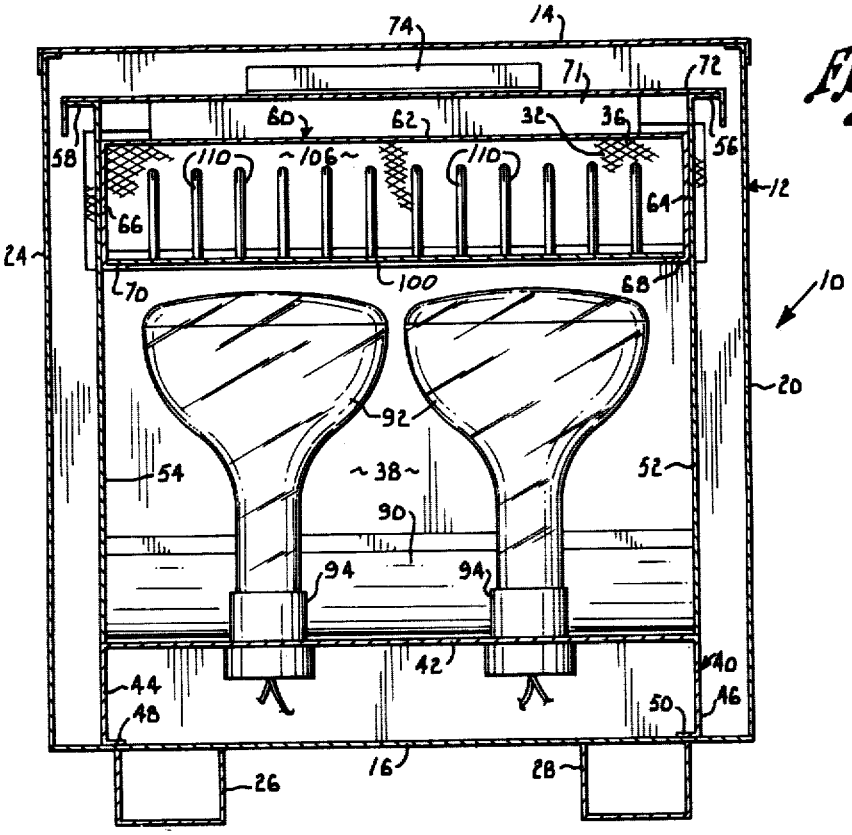
Fig. 4.
Fig. 5.
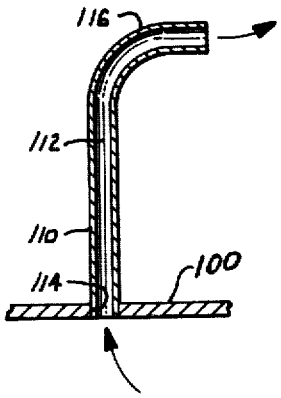

MODULAR INFRARED SPACE HEATER DEVICE

BACKGROUND AND BRIEF DESCRIPTION OF THE INVENTION

I also have a pending application Ser. No. 797,257 filed May 16, 1977, entitled Modular Infrared Space Heater Device, now U.S. Pat. No. 4,197,447.

Infrared heaters have been known for years but a continuing problem with these heaters has been the inefficiency thereof. The prior art includes U.S. Pat. No. 3,180,972 issued to D. W. Covault on Apr. 27, 1965. This patent discloses an end table heater including a fan, lamps, heat exchanging plates and conductor rods over which air is circulated. Another patent of interest is U.S. Pat. No. 3,575,582 issued to D. W. Covault on Apr. 20, 1971. This patent shows an electrical furnace comprising a cabinet structure, a plurality of lamps, a fan assembly and a heat exchanger consisting of an elongated cylinder having a plurality of prong shaped heat transmitting elements attached to it. In this furnace, air is circulated by the fan assembly through and around the heat exchanger such that it is capable of absorbing heat from the heat exchanger and heat transmitting elements. The heated air then exits in the furnace through a louver in the top of the device. Other references representative of the prior art include the following: U.S. Pat. No. 2,520,830, issued to Borzner on Apr. 29, 1950; U.S. Pat. No. 2,938,101, issued to Borzner on May 24, 1960; U.S. Pat. No. 3,104,307 issued to Garfalow, et al. on Sept. 17, 1963; U.S. Pat. No. 2,527,013 issued to Kjelgaard on Oct. 24, 1950; U.S. Pat. No. 2,919,338 issued to Covault, et al. on Dec. 29, 1959; and U.S. Pat. No. 2,379,705 issued to Graves on July 3, 1945.

The present invention, however, pertains to an improved heater having a unique construction which significantly improves the efficiency of this heater over any of the above noted systems. In particular, the heating device of the present invention is comprised of a rectangularly shaped heating chamber in which a plurality of infrared lamps are mounted in a vertical orientation. A pair of heat exchanging plates are mounted within the heating chamber adjacent to the lamps to absorb the heat radiated by the lamps. These heat exchanging plates are mounted in spaced apart relationship from one side wall of the heating chamber 50 as to form an outlet channel therewith. This outlet channel communicates with an outlet opening in the devices outer casing and with the heating chamber. A plurality of open-ended tubular conduits are mounted onto the heat exchanging plates such that they extend outward from the plates into the outlet channel. These conduits are mounted to the plates such that the hollow inner portion of each conduit is aligned with a corresponding opening in its associated exchanging plate. The cool air to be heated is pumped into heating chamber by means of a fan mounted within the heater. Within the heating chamber, the incoming air passes over the lamps, over both sides of the heat exchanging plates and through and around the tubular conduits mounted onto the heat exchanging plates. The unique construction of the present invention serves to maximize the amount of heated surface area exposed to the air passing through the heating chamber and, as a result, significantly increases the efficiency of the heater.

It is therefore an object of the present invention to provide a unique and highly efficient electric heater.

Another object of the present invention is to provide an electric heater having a unique construction comprising a heating chamber enclosing a plurality of vertically positioned infrared lamps at least one heat exchanging plate positioned adjacent to the lamps, a plurality of tubular conduits suitably mounted onto the heat exchanging plate wherein the air to be heated is circulated through the heating chamber such that it passes over the lamps located within the chamber, over both sides of the heat exchanging plate and round and through the tubular conduits mounted onto the heat exchanging plate.

A further object of the present invention is to provide a heater of the character described which exposes an extremely large amount of heated surface area to the air circulating through the device.

It is another object of the present invention to provide an electric heater of the character described wherein the lamps are maintained in a vertical position to mitigate the possibility of the lamps becoming loosened or damaged during use.

An additional object of the present invention is to provide an electrical heater of the character described which is arranged to maximize the transfer of heat to the circulating air.

It is yet another object of the present invention to provide an electric heater which is capable of being mounted in furniture pieces such as end tables, occassional tables and other household furniture.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith and in which like reference numerals are employed to indicate like parts in the various views:

FIG. 1 is a perspective view of a modular heating device which is constructed in accordance with a preferred embodiment of the present invention;

FIG. 2 is a rear elevational view of the modular heating device shown in FIG. 1;

FIG. 3 is a cross sectional view on an enlarged scale taken along line 3—3 of FIG. 2;

FIG. 4 is a cross sectional view taken along line 4—4 of FIG. 3;

FIG. 5 is an enlarged sectional view on one of the tubular conduits used in the heating device of the present invention; and FIG. 6 is a schematic diagram of a control circuit which is suitable for use in the heating device of the present invention.

Referring now to FIGS. 1, 2, 3, and 4, numeral 10 is used to generally designate a modular space heater which is constructed in accordance with a preferred embodiment of the present invention. This heater includes an outer casing 12 which is made of metal. The outer casing is basically constructed to have the shape of a cube and is comprised of a top wall 14, a bottom wall 16 and four side walls 18, 20, 22 and 24. The outer casing is supported by a pair of leg structures 26 and 28 which are arranged to rest on the floor or some other support surface. The outer casing also has an intake opening 30 defined in side wall 18 and an outlet opening 32 defined in side wall 22. The intake opening is in turn covered by a protective grill 34 while the outlet opening is covered by a protective grill 36.

The outer casing of the heating device encloses a heating chamber 38. The heating chamber comprises a generally rectangular shaped chamber which is supported above the bottom wall 16 of the casing by means of a floor unit 40. The floor unit is constructed from a single piece of ferrous metal which is formed to provide a rectangular shaped floor area 42 and a pair of lateral support legs 44 and 46 with in-turned end portions 48 and 50, respectively. The floor unit is positioned within the outer casing of the heating device such that the in-turned end portion of each lateral support leg rests upon and is secured to the bottom wall 16 of the outer casing.

As shown in FIG. 4, the heating chamber also includes a pair of opposing side walls 52 and 54. Each of these side walls is comprised of a metal plate which is attached to a lateral edge of the floor unit such that it extends upward from the floor area of the unit at a right angle therewith. In addition, the end portion of side wall 52 is turned outward at 56 to form a right angle with the remainder of the wall. The upper end portion of side wall 54 is likewise turned outward at 58.

The top of the heating chamber is formed by a ceiling unit 60. The ceiling unit is comprised of a U-shaped piece of aluminum having a rectangular ceiling area 62 and a pair of extending side portions 64 and 66. The outer end portion of extending side portions 64 and 66 is bent inward at 68 and 70, respectively. The ceiling unit is in turn carried by a support plate 72 which normally rests on the out turned end portions 56 and 58 of side walls 52 and 54, respectively. The ceiling unit is attached to support plate 72 by means of a pair of U-shaped support brackets 69 and 71. A pair of handles 74 and 76 are mounted onto the upper surface of the support plate 72 to facilitate removal of this plate from the outer casing.

Referring now primarily to FIG. 3, end wall 78 of the heating chamber is formed by a bent piece of sheet metal. One end of this end wall is attached to side wall 18 of the outer casing by means of an L-shaped mounting piece 80. Mounted piece 80 is comprised of an angle iron having a length sufficient to extend from side wall 52 to side wall 54. The other end of end wall 78 is in turn supported above the floor area of the floor unit by means of a second mounting piece 82. Mounting piece 82 is comprised of a piece of sheet metal extending between side walls 52 and 54 of the heating chamber and having an opening in which an electric motor driven fan 84 is located. As shown in FIG. 3, side wall 78 cooperates with side wall 18 to provide an intake channel 86 which communicates with intake opening 30 and heating chamber 38.

The other end wall of the heating chamber is designated by the numeral 88 and is comprised of a rectangular plate having a length sufficient to extend between side walls 52 and 54 of the heating chamber. The bottom edge of this plate is fixedly secured to the floor area of the floor unit. The upper end of this plate, on the other hand, is bent outward and secured to side wall 22 of the outer casing. In addition, a metal plate 90 is attached to the floor area of the floor unit and to metal plate 88 to improve the flow of air through the heating chamber.

Referring now primarily to FIGS. 3 and 4, a plurality of infrared lamps 92 are located within the heating chamber. These lamps are of a conventional design and serve as the heat source in the present invention. The infrared lamps 92 are designed and constructed to be used in any physical plane with equal efficiency. Each of these lamps is mounted within the heating chamber by means of a corresponding lamp socket 94. As shown in these figures, each lamp socket is suitably attached to the floor area 42 of the floor unit so that the lamp carried by the socket is maintained in a vertical position. By mounting the lamps within the heating chamber in a vertical orientation, the lamps are less likely to become loosened by the vibration produced by the motor driven fan 84 during use. While the actual number of lamps employed may vary, the embodiment shown herein includes four lamps which are positioned in a square configuration.

A pair of heat exchanging plates 100 and 102 are carried by the ceiling unit directly above lamps 92. These plates are constructed out of a ferrous metal and are arranged to rest upon the in-turned end portions 68 and 70 of the ceiling unit.

A plurality of isolation baffles 103, 104 and 105 are provided to separate the heat exchanging plates from each other and from the end walls of the heating chamber. These baffles also serve to retain the heat exchanging plates in a stationary position. The isolation baffles are comprised of L-shaped angle irons which are attached to the in-turned end portions 68 and 70 of the ceiling unit such that they span the entire width of the heating chamber. In this arrangement, the heat exchanging plates are positioned adjacent to the heat lamps so that they are capable of absorbing the heat radiated by the lamps.

As shown in FIG. 3, the heat exchanging plates are carried in spaced apart relationship from the ceiling area 62 of the ceiling unit 60 and cooperate with the ceiling area of the ceiling unit and the extending side portions 64 and 66 of the unit to define an outlet channel 106 which communicates with the outlet opening 32 in side wall 22 of the outer casing. In addition, the heat exchanging plates do not cover the entire length of the heating chamber but rather are maintained in spaced apart relationship from end wall 78 of the heating chamber. The area between the isolation baffle 103 and end wall 78 defines an opening 108 which serves to couple the outlet channel 106 with the heating chamber 38. In particular, opening 108 provides an air passage between the outlet channel and the heating chamber.

Referring now to FIGS. 3, 4 and 5, a plurality of open-ended tubular conduits 110 are attached to the heat exchanging plates in uniform rows. Each of these conduits is constructed to have a hollow inner portion 112 and is attached to its associated heat exchanging plate such that the hollow inner portion of the conduit is aligned with a corresponding opening 114 in the plate. These openings provide an air passage between the heating chamber and the hollow inner portion of the tubualr conduits. The tubular conduits are attached to the heat exchanging plates such that they extend outward from the plate into the outlet channel 106. In addition, the upper end portion 116 of each conduit is bent over in the direction in which air flows through said outlet channel 106. In other words, each conduit is bent over to face downstream in said outlet channel. These tubular conduits are typically made of ferrous metal and are preferably constructed to have a diameter of ¼ inch to 11/16 inch.

The heater is equipped with an electrical box 118 which is shown in FIG. 3. This box contains the electrical circuitry for controlling the operation of the device. A schematic diagram of this circuitry is given in FIG. 6 and will be described in greater detail hereinafter. Electrical power is supplied to this circuit through the face plate 120 in side wall 18 of the outer casing.

Reference is now made to FIG. 6 wherein a schematic diagram of the heater's control circuit is shown. The basis components of the control circuit include a conventional thermostat 122, a switching relay 124, the electric motor for fan 84 and lamps 92. The switching relay 124 comprises a solid state zero crossover switching relay which is capable of activating the infrared lamps with a greatly reduced voltage. This reduction in voltage eliminates the in rush surge, thereby significantly extending the lamp's effective life. A pair of input lines 130 and 132 are used to supply operating power to the operating components of the circuit from a conventional AC power source (not shown in this figure). As shown in this figure, thermostat 122 and switching relay 124 are connected in series with each other across input lines 130 and 132. A step down transformer may be included in the circuit to produce a voltage signal suitable for operating thermostat 122. A suitable power signal may also be provided to thermostat 122 through a connector socket 134 which is shown in FIGS. 1 and 3. Thermostat 122 is responsive to the temperature in the room or other area which is being heated and is located remotely of casing 12. The thermostat has leads which connect with a plug that may be inserted in the connector socket 134.

Switching relay 124 is normally open and connected in series with the parallel combination of the fam motor 128 and lamps 92 through a 140° F. resettable breaker 136 such as a Model L 140-2 made by Texas Instruments and a one_time 160° F. thermal fuse 138 such as the one manufactured by Minnesota Mining and Manufacturing Company and designated Model RD 070-002.

In operation, thermostat 122 closes whenever the temperature within the environment monitored by the thermostat drops below a predetermined minimum. Closure of the thermostat results in switching relay 124 being energized thereby causing relay contact 126 to be closed. Upon closure of switching relay 124 operating power is supplied to fan motor 128 causing fan 84 to be activated and to the lamps 92 causing the lamps to be energized.

Upon being energized, the lamps emit heat rays which are absorbed by the heat exchanging plates 100 and 102 thereby causing these plates to be heated. The heat absorbed by the heat exchanging plates is also conducted to the tubular conduits causing the temperature thereof to rise.

Activation of fan 84, on the other hand, causes air to be circulated through the device. The circulating air is initially forced into the heating chamber 38 through the intake channel 86. In the heating chamber, the incoming air is circulated past the bases and necks of the lamps 92. The air is then deflected upward by metal plate 90 and circulates over the tops of the lamps and along the bottom of the heat exchanging plates 100 and 102. As the air moves past the lamps and along the bottom of the heat exchanging plates, it absorbs heat from these components of the device.

As shown by the arrows in FIG. 3, some of the air moving through the heating chamber passes through the hollow inner position of each tubular conduit thereby causing this air to be further heated by exposing it to an additional area of heated surface. The remainder of the air enters outlet channel 106 through opening 108. This air moves through the outlet channel over the top of the heat exchanging plates and around the outer surface of the tubular conduits. In this way, the upper surface of the heat exchanging plates and the outer surface of the tubular conduits further heats the air passing through the outlet channel. As the air moves through the outlet channel, it creates at the opening of each tubular conduit a vacuum which facilitates the movement of air through the conduit. The heated air then exits the heater through outlet opening 32 in side wall 22 of the outer casing.

Once the monitored temperature rises above the preselected minimum, thermostat 122 returns to an open condition thereby de-energizing switching relay 124. Deenergization of this switching relay terminates the operation of fan motor 128 and lamps 92. The heater remains in a non-operating condition until the monitored temperature once again drops below the preset minimum thereby causing thermostat 122 to once again be closed. Closure of thermostat 122 causes the abovedescribed process to be repeated until the preset minimum temperature is once again obtained.

From the foregoing, it was seen that this heater is capable of exposing a large amount of heated surface area to the air passing through the heater thereby significantly enhancing the efficiency of this device.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. An electrical heating device comprising:

an outer casing presenting therein a heating chamber having at least one side wall, said casing having top, bottom and side walls and an inlet opening communicating with said chamber and an outlet opening;

a plate member constructed of a heat conductive material, said plate member being supported within said casing at a location to form one boundary of the heating chamber and at a location spaced from a portion of the casing to present a discharge channel having an inlet at one end communicating with the interior of said heating chamber and an opposite end communicating with said outlet opening to direct air through the discharge channel in a direction generally parallel to the plate member, said plate member forming a partition between said heating chamber and discharge channel;

electric heating means in said heating chamber for effecting heating of said heating chamber and said plate member;

a plurality of open-ended conduits each mounted to said plate member and projecting into said discharge channel therefrom generally transversely of the direction of air flow through the channel, each conduit having an open inlet end communicating with said heating chamber and an open outlet end disposed in said discharge channel and extending generally parallel to the direction of air flow therein to induce air flow through said conduits in response to air flow in said discharge channel; and fan means for circulating air from said inlet opening and through said heating chamber and discharge channel to said outlet opening, whereby the heat in said heating chamber is conducted through said plate member and the flow in said discharge channel induces flow of heated air through said conduits from said heating chamber to said discharge channel.

2. A device as set forth in claim 1, including:

an electric circuit operable when completed to energize said electric heating means and fan means;

a solid state zero crossover switching relay arranged to complete said electric circuit when the relay is energized; and thermostat switch means for energizing said relay when the ambient temperature monitored by said thermostat switch means is below a preselected level.

3. An electrical heating device comprising:

a substantially enclosed outer casing having an inlet opening and an outlet opening, said casing being formed by interconnected walls;

means presenting a heating chamber within said casing in communication with said inlet opening, said heating chamber being defined between a plurality of walls mounted within the casing and spaced inwardly of the casing walls, said walls of the heating chamber incuding a front wall and a back wall;

a heat conductive plate member forming the top wall of said heating chamber and spaced below the top of the casing to present an elongated discharge channel above said plate member in communication with said outlet opening, said plate member being spaced from the front wall of the heating chamber to present a passage which provides communication between said heating chamber and discharge channel;

a plurality of infrared lamps mounted in said heating chamber each having a base portion in the lower region of the heating chamber and a top portion in the upper region of the heating chamber, each lamp emitting heat when energized for heating the chamber and plate member;

fan means for drawing ambient air from said inlet opening into said heating chamber adjacent said front wall and circulating the air in a pattern passing it past the base portions of said lamps from said front wall toward the back wall of the heating chamber and deflecting the air off of said back wall back toward said front wall past the top portions of the lamps and through said passage into said discharge channel for passage therethrough generally parallel to said plate member and discharge through said outlet opening; and a plurality of open-ended conduits mounted to said heat conductive plate member, each conduit having an open inlet end communicating with said heating chamber and an open outlet end in said discharge channel arranged relative to the direction of air flow in the channel for inducing air flow through said conduits from the heating chamber to the discharge channel in response to air flow through said channel toward the outlet opening.

4. A device as set forth in claim 3, wherein each conduit has an end portion adjacent said outlet end which is turned in said discharge channel to extend generally parallel to the direction of air flow in said channel.

5. A device as set forth in claim 3, including a deflector plate in said heating chamber in the lower region thereof adjacent said back wall of the chamber, said deflector plate presenting an inclined surface thereon for deflecting the air generally upwardly and toward said front wall to direct the air past the top portions of said lamps.

* * * * *